US008790086B2

(12) United States Patent
Honkomp et al.

(10) Patent No.: US 8,790,086 B2
(45) Date of Patent: Jul. 29, 2014

(54) TURBINE BLADE ASSEMBLY FOR RETAINING SEALING AND DAMPENING ELEMENTS

(75) Inventors: Mark Steven Honkomp, Taylors, SC (US); Matthew Durham Collier, Simpsonville, SC (US); Jason Douglas Herzlinger, Greenville, SC (US)

(73) Assignee: General Electric Company, Schenectady, NY (US)

( * ) Notice: Subject to any disclaimer, the term of this patent is extended or adjusted under 35 U.S.C. 154(b) by 930 days.

(21) Appl. No.: 12/944,209

(22) Filed: Nov. 11, 2010

(65) Prior Publication Data

US 2012/0121423 A1 May 17, 2012

(51) Int. Cl.
*F01D 5/10* (2006.01)
*F01D 5/26* (2006.01)

(52) U.S. Cl.
USPC ..... 416/190; 416/500

(58) Field of Classification Search
USPC ..... 416/190, 220 R, 221, 500
See application file for complete search history.

(56) References Cited

U.S. PATENT DOCUMENTS

| | | | | |
|---|---|---|---|---|
| 3,834,831 | A | 9/1974 | Mitchell | |
| 4,872,812 | A | 10/1989 | Hendley et al. | |
| 4,936,749 | A * | 6/1990 | Arrao et al. | 416/193 A |
| 5,513,955 | A | 5/1996 | Barcza | |
| 5,573,375 | A | 11/1996 | Barcza | |
| 5,746,578 | A * | 5/1998 | Brassfield et al. | 416/190 |
| 5,749,705 | A * | 5/1998 | Clarke et al. | 416/190 |
| 5,803,710 | A | 9/1998 | Dietrich et al. | |
| 5,924,699 | A | 7/1999 | Airey et al. | |
| 6,086,329 | A | 7/2000 | Tomita et al. | |
| 6,273,683 | B1 * | 8/2001 | Zagar et al. | 416/193 A |
| 6,354,803 | B1 * | 3/2002 | Grover et al. | 416/190 |
| 6,776,583 | B1 * | 8/2004 | Wang et al. | 416/220 R |
| 6,851,932 | B2 | 2/2005 | Lagrange et al. | |
| 7,021,898 | B2 | 4/2006 | Elliott et al. | |
| 7,104,758 | B2 * | 9/2006 | Brock et al. | 416/190 |
| 7,121,800 | B2 | 10/2006 | Beattie | |
| 7,481,614 | B2 | 1/2009 | Tomita et al. | |
| 7,534,090 | B2 | 5/2009 | Good et al. | |
| 7,575,416 | B2 * | 8/2009 | Funk et al. | 416/193 A |
| 7,628,588 | B2 | 12/2009 | Itzel et al. | |
| 7,731,482 | B2 * | 6/2010 | Lagrange et al. | 416/190 |
| 2006/0056975 | A1 * | 3/2006 | Honkomp et al. | 416/193 A |
| 2010/0111700 | A1 * | 5/2010 | Kim et al. | 416/219 R |

* cited by examiner

*Primary Examiner* — Ned Landrum
*Assistant Examiner* — Joshua R Beebe
(74) *Attorney, Agent, or Firm* — Cantor Colburn LLP

(57) ABSTRACT

A turbine has blade assemblies disposed about a rotor. Each of the blade assemblies have an airfoil and a bucket. Pockets are defined at trailing and leading sides of the bucket, with damper pin slots at an ends thereof. The damper pin slot at the trailing side has a depth sufficient for fully receiving a damper pin. The damper pin slot at the trailing side of a first adjacent blade assembly is positioned relative to the damper pin slot at the leading side of a second adjacent blade assembly to allow the damper pin to move. At each side of the pocket at the trailing side is a seal pin slot with seal pins therein. The seal pin slots extend beyond a line that is aligned with an inner edge of the damper pin slot at the trailing side, wherein the seal pins overlap the damper pin.

19 Claims, 6 Drawing Sheets

TURBINE BLADE ASSEMBLY FOR RETAINING SEALING AND DAMPENING ELEMENTS

BACKGROUND OF THE INVENTION

The subject matter disclosed herein relates to turbines, and more particularly to a mechanism for damping vibrations and sealing the spaces between adjacent blade assemblies of circumferentially spaced blade assemblies in a turbine.

Turbine engines typically have a plurality of circumferentially spaced blade assemblies mounted on a rotor for rotation therewith about the rotor axis. These blade assemblies exist in a number of different shapes and configurations, but generally have an innermost dovetail portion an intermediate portion with a platform portion having shank portions depending therefrom and an outermost airfoil portion, with the dovetail portion being slidably received in a complimentarily configured recess provided in the rotor. The shank portions separate the dovetail and platform portions, while also defining a pocket for cooling fluid. It has become common practice to introduce cooling fluid, usually air, between adjacent blade assemblies to enhance metallurgical limitation on blade assemblies operating under high inlet temperatures. The platform portions separate the shank and airfoil portions. The airfoil portion typically depends radially into the passageway to interact with the working fluid. At the same time, however, these airfoil portions are subject to harmonic stimuli. The source and nature of such blade vibrations are difficult to identify and eliminate. There is a general need and desire to damp such vibrations. So it has become common practice for damper assemblies to effectively decrease the harmonic stimuli of a turbine engine.

Although these known damper assemblies may be largely adequate, the cooling fluid leaks across the damper assemblies into the working fluid, decreasing the efficiency of the turbine engine. So it has become particularly beneficial to use a damper assembly that can improve sealing about adjacent blade assemblies.

BRIEF DESCRIPTION OF THE INVENTION

According to one aspect of the invention, a turbine has at least two adjacent blade assemblies circumferentially disposed about a rotor of the turbine.

Each of the at least two adjacent blade assemblies has a bucket having a platform with a first pocket defined at a trailing side of the bucket and a second pocket defined at a leading side of the bucket. The bucket further has a first damper pin slot at one end of the first pocket and a second damper pin slot at one end of the second pocket. Each of the at least two adjacent blade assemblies further has an airfoil projecting into a stream of the turbine, whereby kinetic energy of the stream is converted into mechanical energy through rotation of the rotor. The airfoil extends outwardly from the platform. A damper pin is received in at least one of (i) the first damper pin slot of a first of the at least two adjacent blade assemblies and (ii) the second damper pin slot of a second of the at least two adjacent blade assemblies. The first damper pin slot of the first of the at least two adjacent blade assemblies is positioned relative to the second damper pin slot of the second of the at least two adjacent blade assemblies to allow the damper pin to move within the first damper pin slot of the first of the at least two adjacent blade assemblies and the second damper pin slot of the second of the at least two adjacent blade assemblies. The first damper pin slot has a depth sufficient for fully receiving the damper pin therein.

According to another aspect of the invention, a blade assembly has a bucket having a platform with a pocket defined at one side of the bucket. The bucket further has a damper pin slot at one end of the pocket and a seal pin slot at each side of the pocket. The seal pin slots extend beyond a line that is aligned with an edge of the damper pin slot. The blade assembly further has an airfoil extending outwardly from the platform. Seal pins are received in the seal pin slots. A damper pin is received in the damper pin slot, wherein the seal pins overlap the damper pin.

According to yet another aspect of the invention, a turbine has at least two adjacent blade assemblies circumferentially disposed about a rotor of the turbine.

Each of the at least two adjacent blade assemblies has an airfoil projecting into a stream of the turbine, whereby kinetic energy of the stream is converted into mechanical energy through the rotation of the rotor, and a bucket having a platform with the airfoil extending outwardly therefrom. A pocket is defined at one side of the bucket of at least one of the at least two adjacent blade assemblies. A damper pin slot is located at one end of the pocket. At each of (i) one side of the pocket and (ii) one side of the bucket of the other one of the at least two adjacent blade assemblies is a seal pin slot. The seal pin slots are disposed at opposing sides of the pocket when the two blade assemblies are adjacent. The seal pin slots extend beyond a line that is aligned with an edge of the damper pin slot. Seal pins are received in the seal pin slots. A damper pin is received in the damper pin slot, wherein the seal pins overlap the damper pin.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
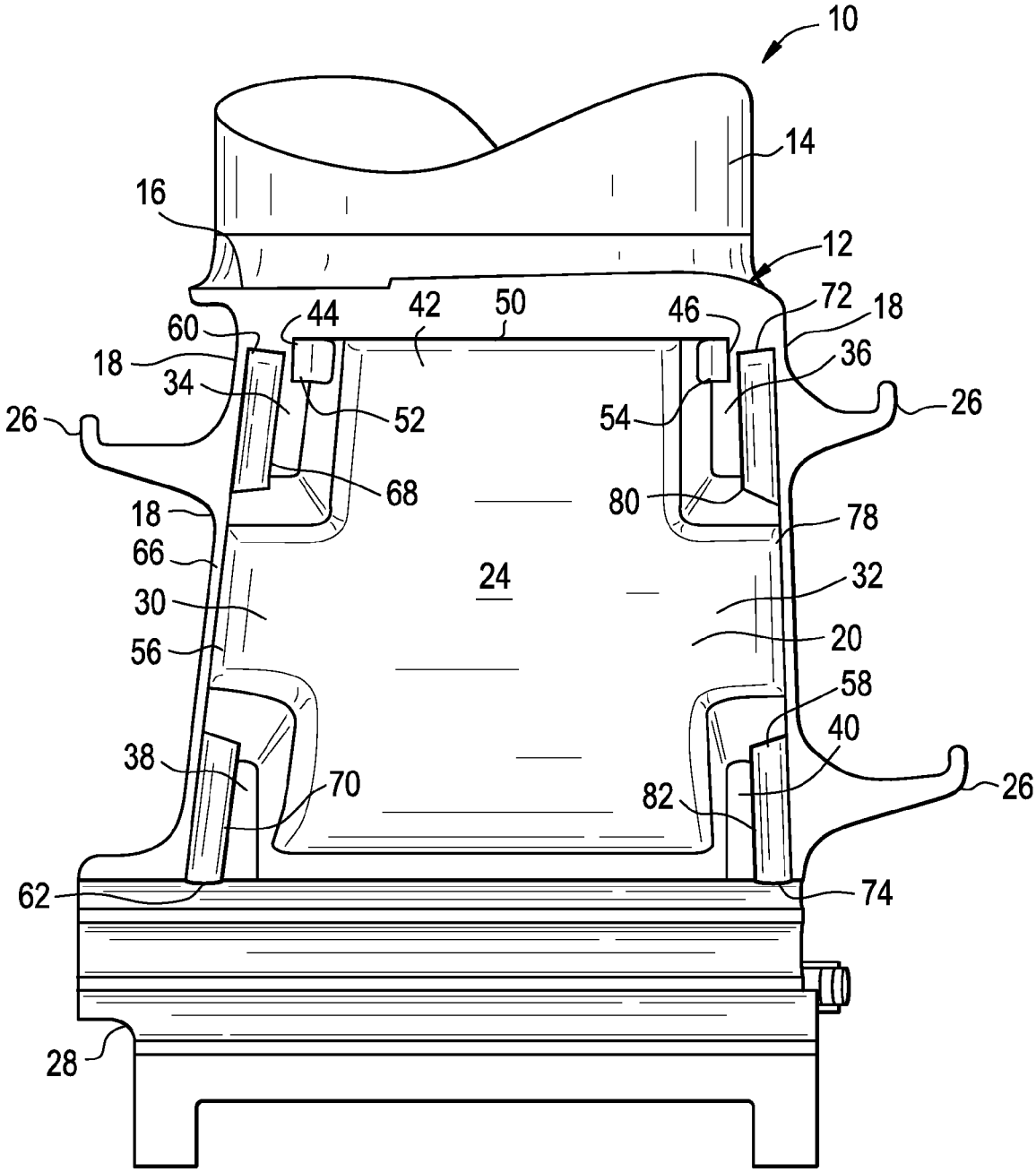
FIG. 1 is a partial side view of a turbine blade assembly at a trailing side thereof in accordance with an embodiment of the invention.
Figure 2:
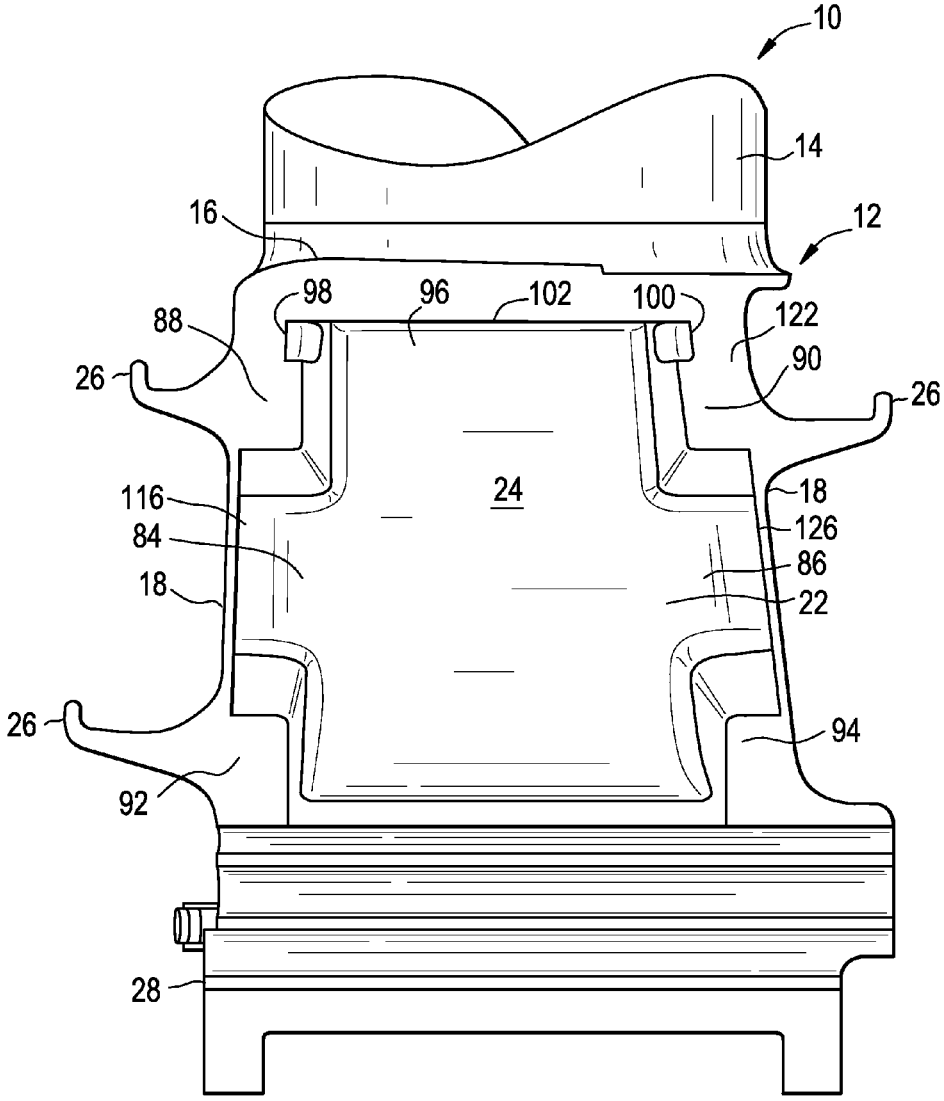
FIG. 2 is a partial side view of the turbine blade assembly at a leading side thereof in accordance with an embodiment of the invention.

Referring to FIGS. 1 and 2, partial views of a blade assembly 10 are generally shown. The blade assembly 10 is one of a plurality of blade assemblies circumferentially disposed about the rotor of a turbine (not shown). The blade assembly 10 includes a bucket 12 having an airfoil 14 that projects into a stream of the turbine so as to enable the kinetic energy of the stream to be converted into mechanical energy through the rotation of the rotor. A platform 16 has shank portions 18 depending therefrom defining a pocket 20 at the trailing side of the bucket 12 and a pocket 22 at the leading side of the bucket 12. The pockets 20 and 22 are separated by a wall portion 24. The platform 16 at the trailing side of the bucket 12 is sealed and damped against a platform at the leading side of an adjoining bucket (not shown). The platform 16 at the leading side of the bucket 12 is sealed and damped against a platform at the trailing side of another adjoining bucket (not shown). The airfoil 14 extends outwardly from the platform 16. The shank portions 18 include axially spaced supports 26. An interlocking connector, such as a dovetail 28, extends from the shank portions 18. The dovetail 28 is configured to be received in a cooperating opening in the rotor of the turbine (not shown). These openings in the rotor are axially aligned or slightly off axis.

Figure 3:
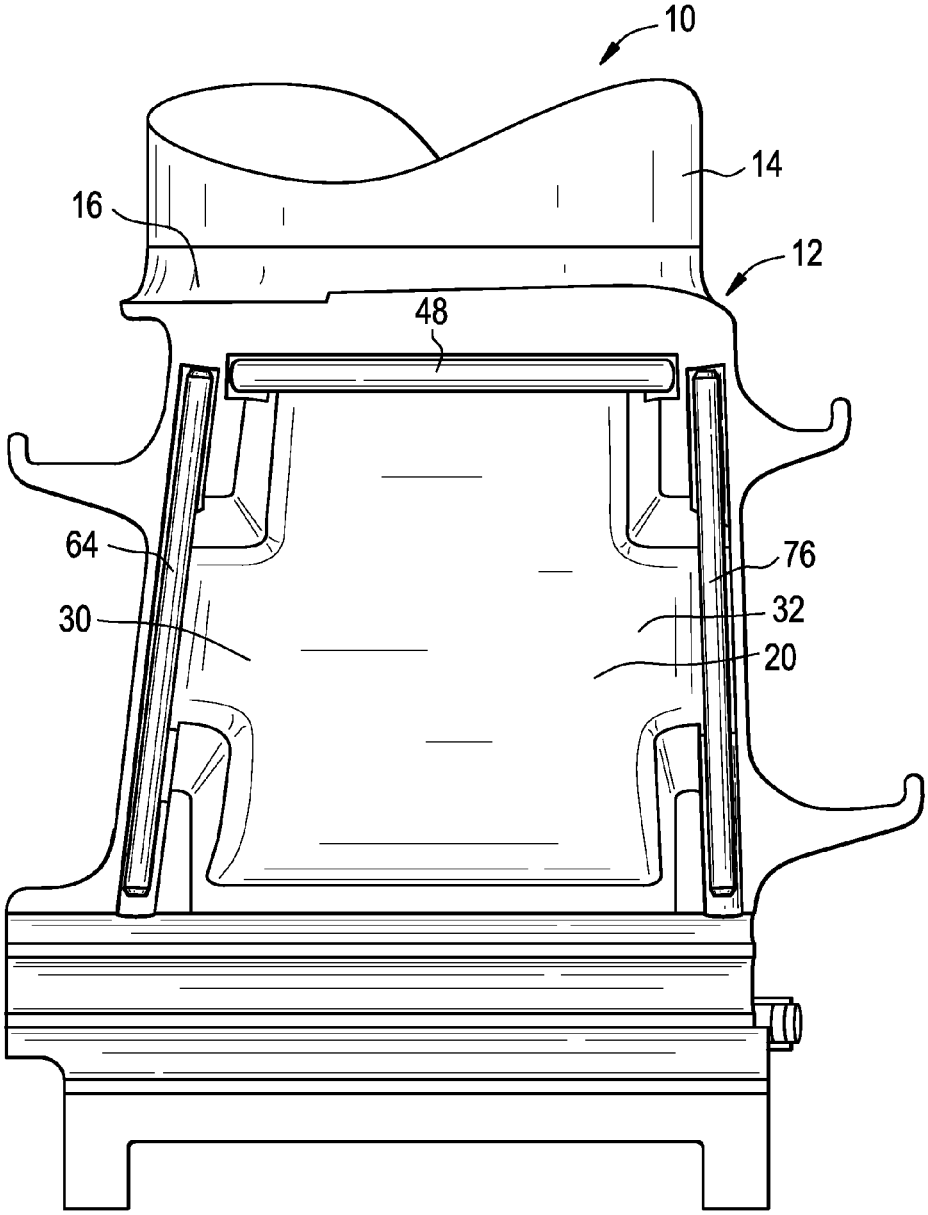
FIG. 3 is a partial side view of the turbine blade assembly at the trailing side thereof with seal and damper pins in accordance with an embodiment of the invention.
Figure 4:
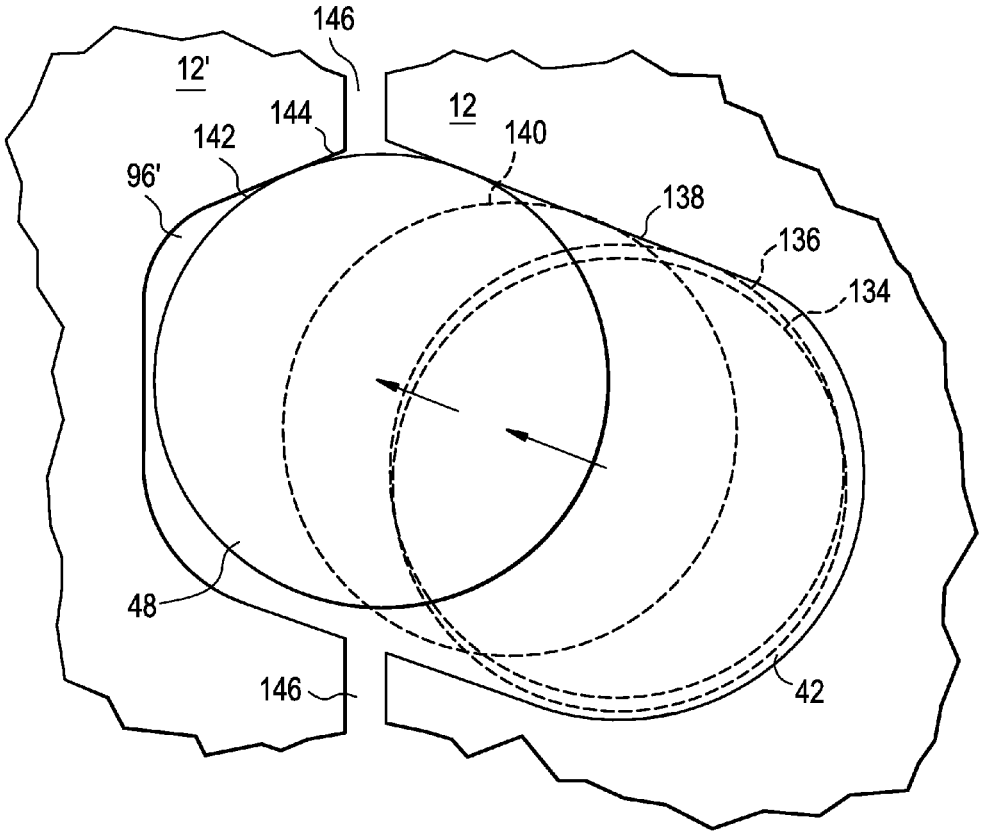
FIG. 4 is a partial side cross-sectional view of damper pin slots and a damper pin slot of adjacent turbine blade assemblies in accordance with an embodiment of the invention.
Figure 5:
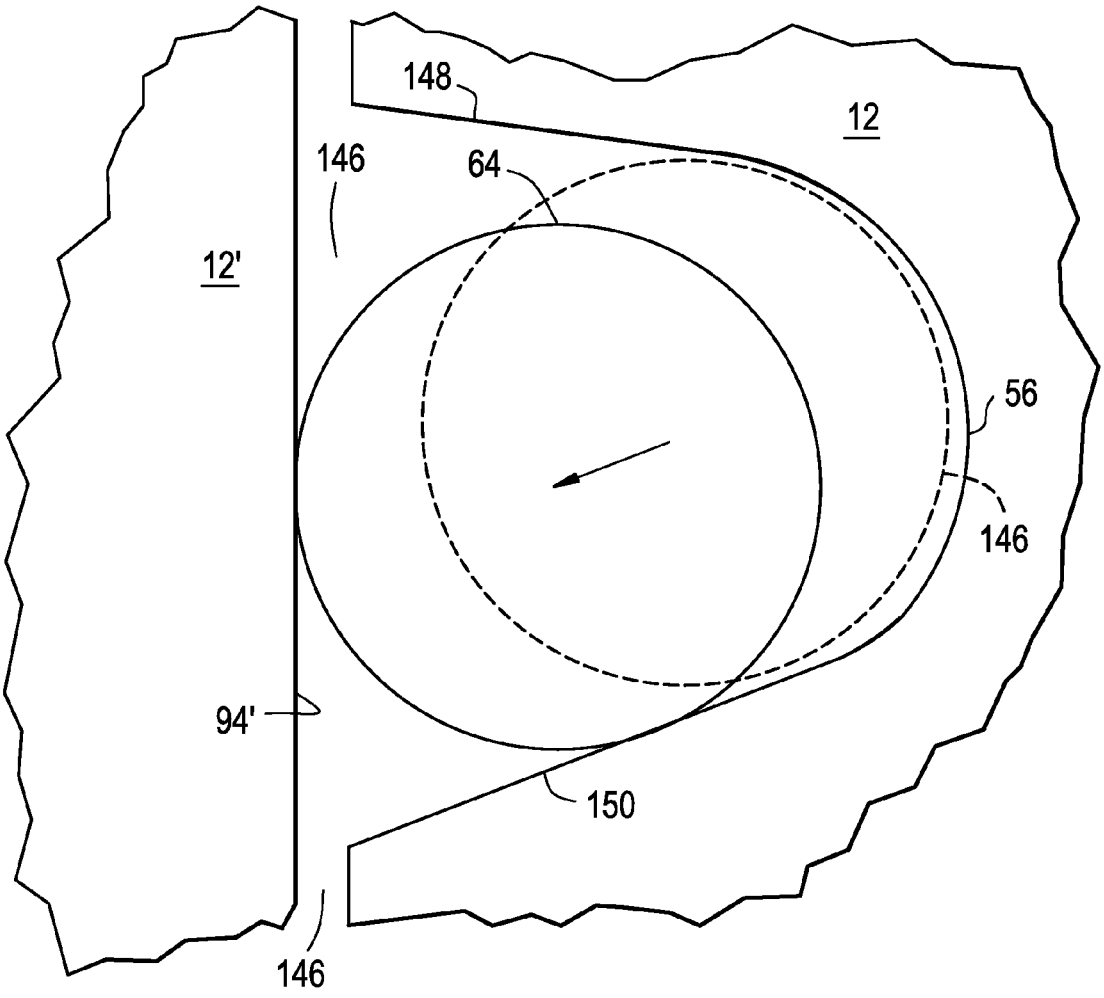
FIG. 5 is a partial end cross-sectional view of a seal pin slot and a seal pin of adjacent turbine blade assemblies in accordance with an embodiment of the invention.
Figure 6:
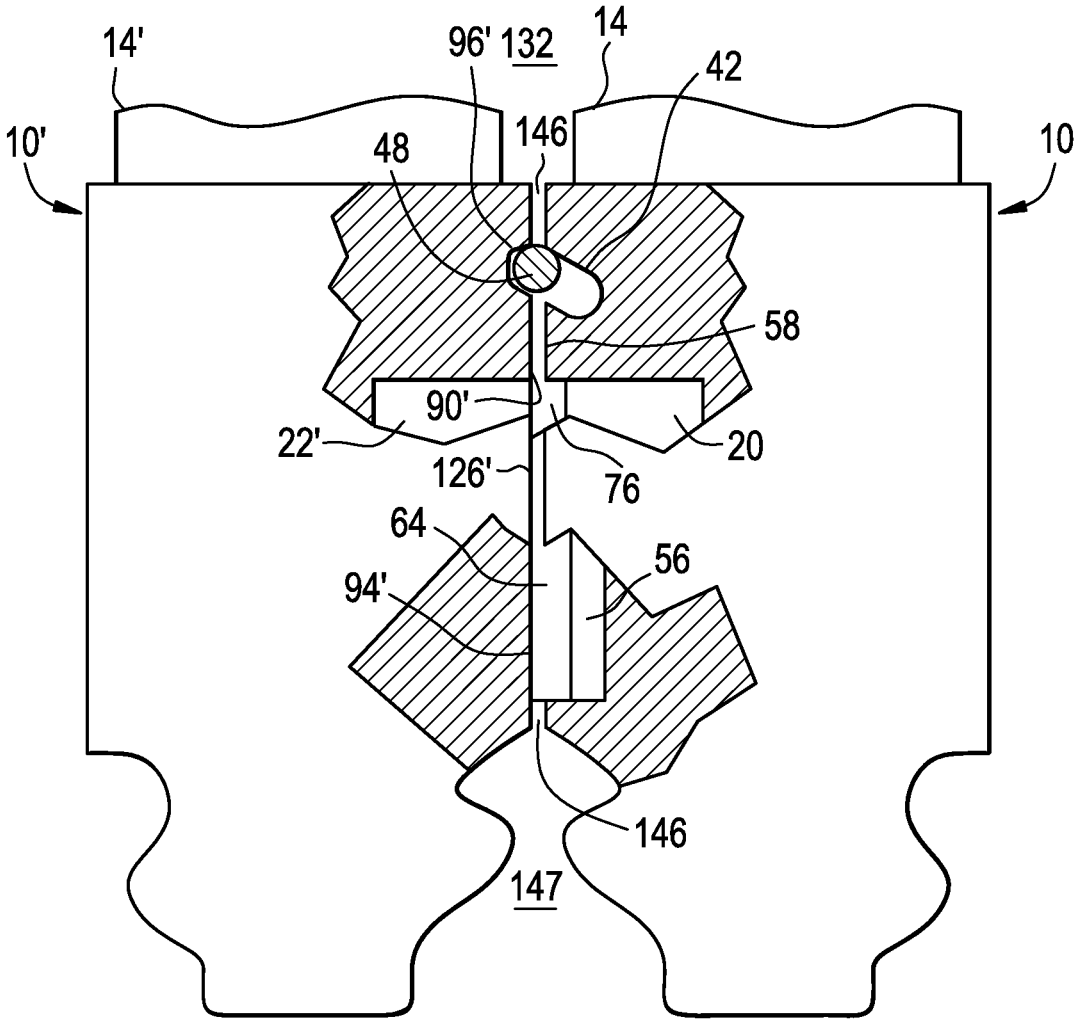
FIG. 6 is a partial side view with portions in cross-section of adjacent turbine blade assemblies in accordance with an embodiment of the invention.

Referring also to FIGS. 3, 4, and 5, the pocket 20 at the trailing side is generally rectangular in shape having lateral extensions 30 and 32. Outer ledges 34 and 36 are formed above and inner ledges 38 and 40 are formed below, the lateral extension 30 and 32. At one end of the pocket 20 is a damper pin slot 42. The damper pin slot 42 has ends 44 and 46 that extend into the outer ledges 34 and 36 for receiving a damper pin 48. The damper pin slot 42 is bound by an edge 50 at the outer end and edges 52 and 54 at the inner end, with a portion of the inner end opening up into the pocket 20. The damper pin slot 42 is generally U-shaped and is skewed inwardly when viewed from an end thereof, although other shapes may suffice, e.g., semi-circular. The damper pin slot 42 has a depth sufficient for fully receiving the damper pin 48, the fully recessed damper pin 48 is an important feature. At each side of the pocket 20 are seal pin slots 56 and 58. The seal pin slot 56 has ends 60 and 62 that extend into the outer ledge 34 and the inner ledge 38, respectively, for receiving a seal pin 64. The seal pin slot 56 is bound by an edge 66 at the one side and edges 68 and 70 at the other side, with a portion of this other side opening up into the extension 30 of the pocket 20. The seal pin slot 56 is generally U-shaped and is skewed generally circumferentially when viewed from an end thereof, although other shapes may suffice, e.g., semi-circular. The seal pin slot 56 has a depth sufficient for fully receiving the seal pin 64. The seal pin slot 58 has ends 72 and 74 that extend into the outer ledge 36 and the inner ledge 40, respectively, for receiving a seal pin 76. The seal pin slot 58 is bound by an edge 78 at the one side and edges 80 and 82 at the other side, with a portion of this other side opening up into the extension 32 of the pocket 20. The seal pin slot 58 is generally U-shaped and is skewed generally circumferentially when viewed from an end thereof, although other shapes may suffice, e.g., semi-circular. The seal pin slot 58 has a depth sufficient for fully receiving the seal pin 76. The end 60 extends beyond, a line that is aligned with the edge 52 of the damper pin slot 42, so as to cause an overlap of the seal pin 64 with the damper pin 48, when viewed from an end perspective (FIG. 6). The end 72 extends beyond, a line that is aligned with the edge 54 of the damper pin slot 42, so as to cause an overlap of the seal pin 76 with the damper pin 48, when viewed from an end perspective (FIG. 6). This overlapping is an important feature.

The pocket 22 at the leading side is generally rectangular in shape having lateral extensions 84 and 86 bound by edges 116 and 126, respectively. Outer ledges 88 and 90 are formed above and inner ledges 92 and 94 are formed below, the lateral extension 84 and 86. At one end of the pocket 22 is a damper pin slot 96. The damper pin slot 96 has ends 98 and 100 that extend into the outer ledges 88 and 90 for receiving a damper pin from an adjoining bucket (not shown). The damper pin slot 96 is bound by an edge 102 at the outer end and edges 104 and 106 at the inner end, with a portion of the inner end opening up into the pocket 22. The damper pin slot 96 is generally U-shaped and widens at the opening of the U-shape when viewed from an end thereof. The damper pin slot 96 has a depth sufficient for partially receiving the damper pin from an adjoining bucket (not shown) when the damper pin is fully loaded by the centrifugal forces induced by the rotation of the turbine. The shifting of the damper pin 48 in the bucket 12 from fully recessed in the damper pin slot 42 when unloaded to a damper pin slot 96' in an adjacent bucket 12' when fully loaded is an important feature and is discussed further below.

In highly efficient modern combustion turbine engines the seal about adjacent blade assemblies 10, 10' is of great importance as cooling flow that leaks is essentially wasted energy. Referring to FIG. 6 the invention utilizes cooperating damper pin slots 42, 96' supporting the damper pin 48 in combination with overlapping seal pins 64, 76 to form a uniform gap 146 about adjacent blade assemblies 10, 10', thereby preventing the loss of cooling air from adjacent pockets 20 and 22' and an area 147 defined inwardly therefrom by adjacent blade assemblies 10,10' to an area 132 of the working fluid passing adjacent airfoils 14, 14'. While the damper pin slots 42, 96' are skewed at an angle (i.e., an angle between 0° and 90° relative to a line tangential to rotation about the rotor), such as an inner flow path angle (i.e., the angle at which the working fluid flows) or other angles such as to improve the efficiency of the combustion turbine engine. Referring again to FIG. 4, the at rest position of the damper pin 48 within the slots 42 and 96' is dependent on the rotational position of the blade assemblies 10, 10'. However, during rotation the damper pin 48 will move outwardly and toward the slot 96' (as indicated by the broken line illustrations) to its fully loaded position (indicated by the solid line illustration). The centrifugal forces induced on the damper pin 48 by the rotation of the turbine is outwardly on the damper pin 48, causing the damper pin 48 to move from an initial position 134 to a second position 136 where the damper pin 48 impacts a surface 138 of the slot 42. The angle of the surface 138 and the outward centrifugal force cause the damper pin 48 to move toward the slot 96', as indicated by a position 140. The damper pin 48 continues to move along the surface 138 until it is received in the slot 96', indicated by a position 142, which is the fully loaded position for the damper pin 48. In the fully loaded position the damper pin 48 is in contact with the surface 138 of the slot 42 and a surface 144 of the slot 96' across a gap 146 where the slots meet, which provides sealing in combination with the overlapping seal pins, as discussed herein. The damper pin 48 also removes harmonic stimuli between adjacent blade assemblies 10, 10' of the turbine during operation. Decreasing the harmonic stimuli between blade assemblies 10, 10' reduce stresses in the turbine. Referring again to FIG. 5, the at rest position of the seal pin 64 within the slot 56 is dependent on the rotational position of the blade assemblies 10, 10'. It will be appreciated that while the seal pin 64 is being described, the same analogously applies to the seal pin 76. However, during rotation the seal pin 64 will move circumferentially toward the ledges 90', 94' and the edge 126' (as indicated by the broken line illustration) to its fully loaded position (indicated by the solid line illustration). The centrifugal forces induced on the seal pin 64 by the rotation of the turbine is generally axially and generally circumferentially on the seal pin 64, causing the seal pin 64 to move from an initial position 146 along the surfaces 148 and 150 of the slot 56 until it contacts the ledges 90', 94' and the edge 126', which is the fully loaded position for the seal pin 64. In the fully loaded position the seal pin 64 is in contact with the surfaces 148 and 150 of the slot 56, the ledges 90', 94', and the edge 126', which provides uniform sealing. Alternatively, the seal pin slots 56 and 58 could be located on the opposite side of the bucket 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine having at least two adjacent blade assemblies circumferentially disposed about a rotor of the turbine, the turbine comprising:

each of the at least two adjacent blade assemblies having:

a bucket having a platform with a first pocket defined at a trailing side of the bucket and a second pocket defined at a leading side of the bucket, the bucket further having a first damper pin slot at one end of the first pocket and a second damper pin slot at one end of the second pocket, and an airfoil projecting into a stream of the turbine, whereby kinetic energy of the stream is converted into mechanical energy through rotation of the rotor, the airfoil extending outwardly from the platform; and a damper pin received in at least one of (i) the first damper pin slot of a first of the at least two adjacent blade assemblies and (ii) the second damper pin slot of a second of the at least two adjacent blade assemblies, the first damper pin slot of the first of the at least two adjacent blade assemblies is positioned relative to the second damper pin slot of the second of the at least two adjacent blade assemblies to allow the damper pin to move within the first damper pin slot of the first of the at least two adjacent blade assemblies and the second damper pin slot of the second of the at least two adjacent blade assemblies, the first damper pin slot has a depth sufficient for fully receiving the damper pin therein and a concave surface disposed directly adjacent to a planar surface, wherein the first damper pin slot of the first of the at least two adjacent blade assemblies is positioned relative to the second damper pin slot of the second of the at least two adjacent blade assemblies by being skewed at an angle, which is about the same as an inner flow path angle of the turbine.

2. The turbine of claim 1 wherein the second damper pin slot has a depth sufficient for partially receiving the damper pin therein.

3. The turbine of claim 1 further comprising:

at each side of at least one of (i) the first pocket of the first of the at least two adjacent blade assemblies and (ii) the second pocket of the second of the at least two adjacent blade assemblies is a seal pin slot; and seal pins received in the seal pin slots.

4. The turbine of claim 3 wherein:

each of the seal pin slots has a depth sufficient for fully receiving one of the seal pins therein.

5. The turbine of claim 3 wherein the seal pin slots extend beyond a line that is aligned with an edge of at least one of the first damper pin slot and the second damper pin slot, wherein the seal pins overlap the damper pin.

6. The turbine of claim 1 wherein each of the at least two adjacent blade assemblies further has shank portions depending from the platform, the shank portions define the first and second pockets.

7. The turbine of claim 6 wherein each of the at least two adjacent blade assemblies further has an interlocking connector portion extending from the shank portions, the interlocking connector portion being configured to be received in an opening in the rotor.

8. The turbine of claim 7 wherein the interlocking connector portion is a dovetail.

9. A turbine having at least two adjacent blade assemblies circumferentially disposed about a rotor of the turbine, the turbine comprising:

each of the at least two adjacent blade assemblies having:

a bucket having a platform with a first pocket defined at a trailing side of the bucket and a second pocket defined at a leading side of the bucket, the bucket further having a first damper pin slot at one end of the first pocket and a second damper pin slot at one end of the second pocket, and an airfoil projecting into a stream of the turbine, whereby kinetic energy of the stream is converted into mechanical energy through rotation of the rotor, the airfoil extending outwardly from the platform; and a damper pin received in at least one of (i) the first damper pin slot of a first of the at least two adjacent blade assemblies and (ii) the second damper pin slot of a second of the at least two adjacent blade assemblies, the first damper pin slot of the first of the at least two adjacent blade assemblies is positioned relative to the second damper pin slot of the second of the at least two adjacent blade assemblies to allow the damper pin to move within the first damper pin slot of the first of the at least two adjacent blade assemblies and the second damper pin slot of the second of the at least two adjacent blade assemblies, the first damper pin slot has a depth sufficient for fully receiving the damper pin therein, wherein the first damper pin slot of the first of the at least two adjacent blade assemblies is positioned relative to the second damper pin slot of the second of the at least two adjacent blade assemblies by being skewed at an angle, which is about the same as an inner flow path angle of the turbine.

10. A blade assembly comprising:

a bucket having a platform with a pocket defined at one side of the bucket, the bucket further having a damper pin slot at one end of the pocket and a seal pin slot at each side of the pocket, the seal pin slots extend beyond a line that is aligned with an edge of the damper pin slot;

an airfoil extending outwardly from the platform;

seal pins received in the seal pin slots; and a damper pin received in the damper pin slot, wherein the seal pins overlap the damper pin, wherein the damper pin slot is positioned relative to a second damper pin slot of an adjacent blade assembly by being skewed at an angle, which is about the same as an inner flow path angle of a turbine including the blade assembly and the adjacent blade assembly.

11. The blade assembly of claim 10 wherein each of the seal pin slots has a depth sufficient for fully receiving one of the seal pins therein.

12. The blade assembly of claim 10 further comprising:

shank portions depending from the platform, the shank portions define the pocket.

13. The blade assembly of claim 12 wherein the blade assembly further comprising:

an interlocking connector portion extending from the shank portions, the interlocking connector portion being configured to be received in an opening in the rotor.

14. The turbine of claim 13 wherein the interlocking connector portion is a dovetail.

15. A turbine having at least two adjacent blade assemblies circumferentially disposed about a rotor of the turbine, the turbine comprising:

each of the at least two adjacent blade assemblies having an airfoil projecting into a stream of the turbine, whereby kinetic energy of the stream is converted into mechanical energy through the rotation of the rotor, and a bucket having a platform with the airfoil extending outwardly therefrom;

a pocket defined at one side of the bucket of at least one of the at least two adjacent blade assemblies;

a damper pin slot at one end of the pocket;

at each of (i) one side of the pocket and (ii) one side of the bucket of the other one of the at least two adjacent blade assemblies is a seal pin slot, the seal pin slots are disposed at opposing sides of the pocket when the two blade assemblies are adjacent, the seal pin slots extend beyond a line that is aligned with an edge of the damper pin slot;

seal pins received in the seal pin slots; and a damper pin received in the damper pin slot, wherein the seal pins overlap the damper pin, wherein the damper pin slot is positioned relative to a second damper pin slot of an adjacent blade assembly by being skewed at an angle, which is about the same as an inner flow path angle of a turbine including the blade assembly and the adjacent blade assembly.

16. The turbine of claim 15 wherein each of the seal pin slots has a depth sufficient for fully receiving one of the seal pins therein.

17. The turbine of claim 15 wherein the pocket is defined by shank portions depending from the platform.

18. The turbine of claim 17 further comprising:

an interlocking connector portion extending from the shank portions, the interlocking connector portion being configured to be received in an opening in the rotor.

19. The turbine of claim 15 wherein the pocket is defined at a trailing side.

* * * * *

UNITED STATES PATENT AND TRADEMARK OFFICE

CERTIFICATE OF CORRECTION

PATENT NO. : 8,790,086 B2
APPLICATION NO. : 12/944209
DATED : July 29, 2014
INVENTOR(S) : Honkomp et al.

It is certified that error appears in the above-identified patent and that said Letters Patent is hereby corrected as shown below:

In the Claims

In Column 7, Line 9, in Claim 14, delete "The turbine of claim" and insert -- The blade assembly of claim --, therefor.

Signed and Sealed this
Sixteenth Day of June, 2015

Michelle K. Lee

Michelle K. Lee
*Director of the United States Patent and Trademark Office*